US006319336B1

(12) United States Patent
Kamada et al.

(10) Patent No.: US 6,319,336 B1
(45) Date of Patent: Nov. 20, 2001

(54) PERMANENT MAGNET ALLOY HAVING IMPROVED HEAT RESISTANCE AND PROCESS FOR PRODUCTION THEREOF

(75) Inventors: Masami Kamada, Okayama; Michio Obata, Kurume; Yuichi Sato, Yamagata, all of (JP)

(73) Assignee: Dowa Mining Co., Ltd., Tokyo (JP)

( * ) Notice: Subject to any disclaimer, the term of this patent is extended or adjusted under 35 U.S.C. 154(b) by 0 days.

(21) Appl. No.: 09/531,115

(22) Filed: Mar. 20, 2000

Related U.S. Application Data

(63) Continuation-in-part of application No. 09/363,134, filed on Jul. 28, 1999, now abandoned, and a continuation-in-part of application No. PCT/JP99/04048, filed on Jul. 28, 1999.

(30) Foreign Application Priority Data

Jul. 29, 1998 (JP) ..... 10-227522

(51) Int. Cl.[7] ..... H01F 1/057; H01F 1/058; H01F 1/053

(52) U.S. Cl. ..... 148/302; 148/101; 419/12; 75/244

(58) Field of Search ..... 148/301, 302, 148/101; 420/83, 121; 419/12; 75/244

(56) References Cited

U.S. PATENT DOCUMENTS

| | | | | |
|---|---|---|---|---|
| 4,898,613 | * | 2/1990 | Ishigaki et al. | 148/302 |
| 5,053,287 | * | 10/1991 | Mizumoto et al. | 428/694 |
| 5,147,919 | | 9/1992 | Ueda et al. . | |
| 5,181,973 | * | 1/1993 | Hirose et al. | 148/302 |
| 5,200,001 | * | 4/1993 | Hirosawa et al. | 148/302 |

FOREIGN PATENT DOCUMENTS

| | | |
|---|---|---|
| 57-210934 | 12/1982 | (JP) . |
| 59-64733 | 4/1984 | (JP) . |
| 59- 89401 | 5/1984 | (JP) . |
| 60-32306 | 2/1985 | (JP) . |
| 60-34005 | 2/1985 | (JP) . |
| 60- 77959 | 5/1985 | (JP) . |
| 60-221549 | 11/1985 | (JP) . |
| 60-243247 | 12/1985 | (JP) . |
| 62-177149 | 8/1987 | (JP) . |
| 62-206802 | 9/1987 | (JP) . |
| 63-42354 | 2/1988 | (JP) . |
| 63-160211 | 7/1988 | (JP) . |
| 63-241141 | 10/1988 | (JP) . |
| 1-222406 | 9/1989 | (JP) . |
| 2-141559 | 5/1990 | (JP) . |
| 2-266503 | 10/1990 | (JP) . |
| 3-82742 | 4/1991 | (JP) . |
| 3-148803 | 6/1991 | (JP) . |
| 3-177544 | 8/1991 | (JP) . |
| 3-188241 | 8/1991 | (JP) . |
| 3-192703 | 8/1991 | (JP) . |
| 3-278405 | 12/1991 | (JP) . |
| 4-116144 | 4/1992 | (JP) . |
| 4-137501 | 5/1992 | (JP) . |
| 4-152503 | 5/1992 | (JP) . |
| 4-155902 | 5/1992 | (JP) . |
| 6-96928 | 4/1994 | (JP) . |
| 6-287720 | 10/1994 | (JP) . |
| 9-165601 | 6/1997 | (JP) . |
| 10-97907 | 4/1998 | (JP) . |

* cited by examiner

*Primary Examiner*—John P Sheehan
(74) *Attorney, Agent, or Firm*—Frishauf, Holtz, Goodman, Langer & Chick, P.C.

(57) ABSTRACT

A permanent magnet alloy having an improved heat resistance comprising, in terms of % by atom, 0.1 to 15 at. % C, 0.5 to 15 at. % B, provided that C and B in total account for 2 to 30 at. %; 40% or less Co (exclusive), 0.5 to 5 at. % in total of Dy and Tb, 8 to 20 at. % R. where R represents at least one element selected from the group consisting of Nd, Pr, Ce, La, Y, Gd, Ho, Er, and Tm; with the balance being Fe and unavoidable impurities.

21 Claims, 2 Drawing Sheets

PERMANENT MAGNET ALLOY HAVING IMPROVED HEAT RESISTANCE AND PROCESS FOR PRODUCTION THEREOF

This application is a continuation-in-part application of both (i) U.S. application Serial No. 09/363,134, filed Jul. 28, 1999, now abandoned the entire contents of which are hereby incorporated by reference herein, and (ii) International application PCT/JP99/04048, filed Jul. 28, 1999, the entire contents of which are hereby incorporated by reference herein.

TECHNICAL FIELD OF THE INVENTION

The present invention relates to a permanent magnet alloy based on R (wherein R represents yttrium (Y) or a rare-earth element), boron (B), carbon (C), cobalt (Co) and iron (Fe), which exhibits particularly improved heat resistance as such that little degradation occurs on the magnetic force even in case it is used under ambient at a temperature as high as 200° C.

BACKGROUND OF THE INVENTION

A Sm-Co based magnet is known as a rare-earth magnet having improved heat resistance, but is expensive. The term "heat resistance" as referred herein particularly signifies that the magnetic force of the magnet does not degrade by heat. As disclosed in Japanese Patent Public Disclosure No. 4-116144 (Patent No. 2740981), one of inventors of the present invention and others have proposed a R—B—C—Co—Fe based permanent magnet alloy as a rare-earth magnet reduced in cost and yet improved in heat resistance. This magnet alloy contains carbon (C) as an essential alloy element, and utilizes a combination of a light rare-earth element and a heavy rare-earth element for the rare-earth element (R). The disclosure teaches that the irreversible demagnetization of the magnet alloy is improved remarkably (i.e., the negative irreverible demagnetization values approach 0%) by the incorporation of C, and that the irreversible demagnetization is further improved by partly incorporating a heavy rare-earth element for R.

OBJECT OF THE INVENTION

In case a permanent magnet is assembled in appliances that are installed in the vicinity of a heat-emitting source, it is essential that the magnetic force of the permanent magnet does not drop when brought to higher temperatures, i.e., that the residual magnetic flux density (Br) does not undergo degradation when heated. However, there are cases in which the magnet is used under conditions as such that the operation temperature approaches ca. 200° C. (e.g., automobile engine appliances are operated at ca. 200° C., and as a matter of course, the same holds true for motors of electric automotive vehicles). Then, Sm—Co based magnets are the only type of known magnets applicable to this field. However, as stated above, Sm—Co based magnets are expensive, and the ordinary Nd—Fe(Co)—B based rare-earth magnets are unfeasible for such high temperature (e.g., 200° C.) applications.

Although the aforementioned Japanese Patent Public Disclosure No. 4-116144 teaches that the incorporation of C (carbon) as the alloying element in a permanent magnet improves the irreversible demagnetization and that the partial replacement of R by a heavy rare-earth element further improves the irreversible demagnetization, there is not shown any magnet that does not undergo demagnetization when heated to 200° C.

In the light of such circumstances, an object of the present invention is to provide a permanent magnet having improved heat resistance feasible for use at such a high temperature of 200° C., yet at a low production cost.

SUMMARY OF THE INVENTION

In order to achieve the object above based on the fundamental concept of incorporating C to improve the heat resistance of the permanent magnet alloy, as proposed in Japanese Patent Public Disclosure No. 4-116144, the present inventors investigated and studied the influence of each of the heavy rare-earth elements on the heat resistance. As a result, in addition to the incorporation of the basic rare-earth elements such as Nd and Pr, it has been newly found that the addition of Dy and Tb in combination and in proper quantities, particularly when they are added in relation to each other, greatly improves the heat resistance of the permanent magnet.

Thus, in accordance with the present invention, there is provided a permanent magnet alloy having an improved heat resistance comprising, in terms of percent by atom ( at. %), 0.1 to 15 at. % C, 0.5 to 15 at. % B, provided that C and B in total account for 2 to 30 at. %:

40%at.or less Co (exclusive of zero percent), 0.5 to 5 at. % in total of Dy and Tb, preferably, the ratio Tb( at. %)/Dy( at. %) is in the range of from 0.1 to 0.8;

8 to 20 at. % R, where R represents at least one element selected from the group consisting of Nd, Pr, Ce, La, Y, Gd, Ho, Er, and Tm;

with the balance being Fe and unavoidable impurities.

The heat resistance of the permanent magnet alloy is characterized by that the irreversible demagnetization (200° C.) according to the following equation (1) is in the range of 0% to−20%, preferably 0 to−15%, where iHc is 13 KOe or higher:

$$\text{Irreversible Demagnetization (at 200° C.)}=100\times(A_{200}-A_{25})/A_{25} \quad (1)$$

where, $A_{25}$represents a flux value of a magnet measured at room temperature (25° C.), on a specimen prepared into a shape as such that its permeance coefficient Pc be 1, and magnetized at 50 KOe; and $A_{200}$ represents a flux value of a magnet measured on the same specimen subjected to the measurement of $A_{25}$, which was maintained at 200° C. for 120 minutes and then cooled to room temperature (25° C.), for the measurement.

In particular, a permanent magnet alloy having an irreversible demagnetization in the range of 0 to−20% can be obtained by properly selecting the combination of Dy and Tb, e.g., a case in which Dy and Tb in total account for 0.5 to 5 at. % and in which Dy is in the range of 0.3 to 4.9 at. % and Tb is in the range of 0.1 to 4.7 at. % (i.e., the compositional area defined by points A, B, C and D plotted in FIG. 1). Furthermore, a permanent magnet alloy having an irreversible demagnetization in the range of 0 to−15% can be obtained by controlling the content of Dy and Tb to fall in the range defined by points B, C, H, E, F and G plotted in FIG. 1.

DESCRIPTION OF THE PREFERRED EMBODIMENTS

Figure 1:
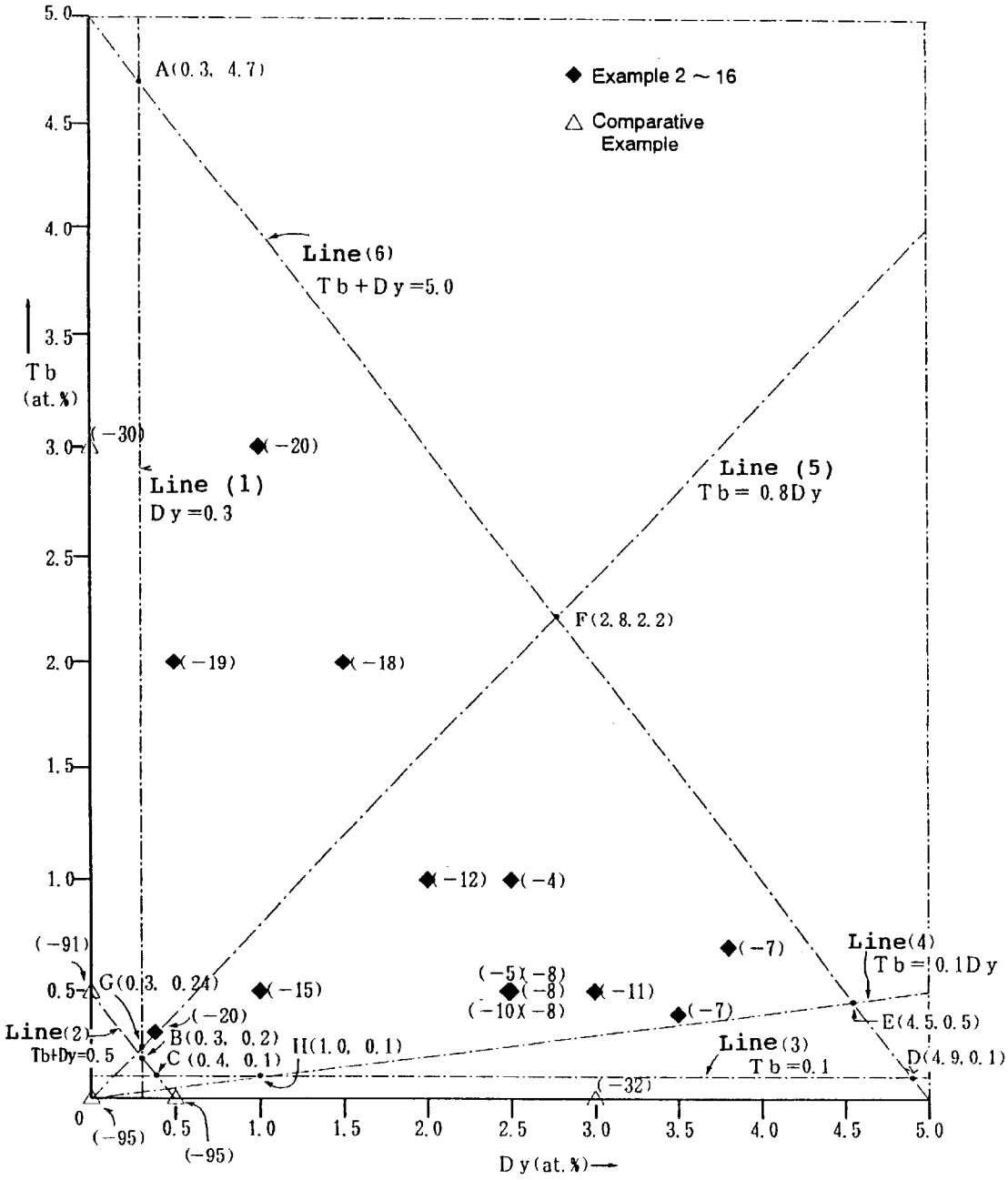
FIG. 1 is a diagram showing the distribution of irreversible demagnetization, in which the values of irreversible demagnetization at 200° C. of the magnets shown in Table 2 are arranged in terms of the content of Dy and Tb.

In designing appliances which may be operated under cases as such that the magnet assembled therein is brought at a temperature of 200° C., the irreversible demagnetization at 200° C. serves as an index. More specifically, it is preferred to select a design that the value (a negative value) of irreversible demagnetization (200° C.) according to equation (1) above approaches 0% as possible.

When a proper amount of C is incorporated into a R—B—Co—Fe based sintered alloy, where R is representatively Nd or a combination of Nd and Pr, the value (negative value) of irreversible demagnetization (160° C.) approaches zero. This fact is shown in the example of Japanese Patent Public Disclosure No. 4-116144. However, the irreversible demagnetization (160° C.) described in this disclosure is obtained by replacing the value of $A_{200}$ by $A_{160}$ (where $A_{160}$ is the flux value of a magnet measured on a specimen maintained at 160° C. for a duration of 120 minutes and then cooled to room temperature), and is an observed value for a permeance coefficient (Pc) of 3. That is, the irreversible demagnetization (160° C.) is a value obtained by magnetizing a specimen shaped as such that Pc be 3 and magnetized at 50 KOe, and by measuring the flux values $A_{25}$ and $A_{160}$. As described in the disclosure, the incorporation of C is known to be effective for improving the heat resistance (and for imparting resistance against oxidation). However, nothing is known about the irreversible demagnetization at 200° C. Furthermore, in the existing R—(Fe,Co)—B based sintered magnet alloys (which do not contain C as the alloy element), none is found to yield an irreversible demagnetization (200° C.) in a range of 0% to −20%.

Since the proposal of the disclosure above, the present inventors have continued various types of tests and researches on the composition of the alloy and the process for the production thereof with an aim to improve the heat resistance of the R—Fe—Co—C—B based sintered magnet alloys, and have found that the combined addition of Dy and Tb in proper quantities results in a magnet alloy having a considerably low irreversible demagnetization. The effect of the addition is not remarkable when Dy or Tb is added independent to each other, but a favorable heat resistance is achieved in case the both are added in combination.

The reason for confining the content of each of the components constituting the magnet allow according to the present invention is outlined below, together with the process for producing the alloy magnet according to the present invention. In the following description, "at. % signifies % by atomic, that is percentage on an atomic basis".

C: 0.1–15 at. %

As described in Japanese Patent Public Disclosure No. 4-116144, the disadvantageous characteristic of a rare-earth magnet, i.e., the tendency prone to oxidation, can be modified by the addition of C while favorably maintaining the magnetic properties of the magnet alloy. Carbon also contributes to the reduction of irreversible demagnetization. If the addition of C is less than 0.1 at. %, the effect thereof on improving the oxidation-resistance and the heat resistance is not sufficient. If the addition of C should exceed 15 at. %, on the other hand, the value of Br begins to drop. Accordingly, C is incorporated at a content in a range of 0.1 to 15 at. %, but a preferred range is 1.0–10 at. %, and more preferably, is in the range of 2.5 to 7 at. %.

B: 0.5 to 15 at. %

Boron (B) is necessary for the formation of a magnetic phase, and it should be present at least 0.5 at. %. However, the addition of B in excessive amount reversibly deteriorates the magnetic properties. Accordingly, B is added in an amount of 0.5 to 15 at. %, preferably 1.0 to 10 at. %, and more preferably, 1.5 to 7 at. %.

C and B in total: 2 to 30 at. %

For the formation of a magnetic phase and the improvement of the resistance against oxidation, C and B in total must account for at least 2 at. %. However, the incorporation of C and B in total exceeding 30 at. % impairs the magnetic properties; accordingly, C and B in total must account for 2 to 30 at. %.

Co: 40 at. % or less

Cobalt elevates the Curie point while maintaining the magnetic properties. Thus, the addition of Co is essential, but an addition thereof in an amount exceeding 40 at. % considerably decreases the coercive force of the magnet. Accordingly, the addition of Co must be 40 at. % or less.

Dy and Tb in total: 0.5 to 5 at,%

Dysprosium (Dy) and terbium (Tb) are the characteristic elements of the magnet of the present invention, and their combined addition remarkably lowers the irreversible demagnetization. For this purpose, Dy and Tb must be added at an amount of 0.5 at. % or more in total, but their effect on improving the heat resistance saturates if a total addition of them is in excess of 5 at. % and it may reversibly affect the magnetic properties. Accordingly, their addition in total must be 0.5 to 5 at. %. As shown hereinafter in the comparative example, the addition of Dy or Tb alone does not contribute to the reduction of irreversible demagnetization. Presumably, Dy and Tb function synergetically to lower the irreversible demagnetization. Furthermore, those elements are preferably added at a Tb( at. %)/Dy( at. %) ratio, expressed by percentage on atomic basis, in the range of 0.1 to 0.8. As shown in the examples hereinafter, the addition of 0.3 to 4.9 at. % of Dy and 0.1 to 4.7 at. % of Tb enables a magnet having improved heat resistance with a irreversible demagnetization at 200° C. at a permeance coefficient of 1 in a range of 0 to−20%, preferably 0 to−15%.

R: 8 to 20 at. %

As rare-earth elements other than Dy and Tb, at least one element selected from the group consisting of Nd, Pr, Ce, La, Y, Gd, Ho, Er and Tm may be added either singly or in combination thereof at an amount of 8 to 20 at. %. By the addition of R, a magnetic phase and a grain boundary phase are developed in the sintered magnet alloy to maintain iHc and Br at high values. Among the elements for R, particularly preferred are Nd and Pr, and the addition of Nd alone or a combination of Nd with Pr is most preferred. If the addition of R is less than 8 at. %, a sufficient high Br cannot be achieved, and the addition of R in excess of 20 at. % results in an insufficient value of Br. A preferred range of R is 13 to 18 at. %.

A permanent magnet alloy according to the present invention having the composition above yields an irreversible demagnetization (200° C.) in accordance with equation (1) above at a low level as such in a range of 0 to–20%, preferably 0 to–15%, and most preferably, 0 to–5%. Thus, the present invention provides for the first time, a permanent magnet alloy other than a Sm—Co based magnet suitable for high temperature use. For high temperature applications, known boron-containing rare-earth magnets having higher coercive force were used by taking the demagnetization at higher temperatures into account. However, since the magnet according to the present invention is almost free of demagnetization even at elevated temperatures, it can be used as it is as a permanent magnet having a high magnetic force. In particular, the magnet according to the present invention can maintain the magnetic properties for use at elevated temperatures at an iHc of 13 KOe or higher, and preferably 15 KOe or higher. Considering that the existing magnets required a considerably high iHc for use in applications at elevated temperatures, the magnet according to the present invention can be regarded as an effective permanent magnet alloy.

The permanent magnet alloy according to the present invention can be produced by a process consisting of sequential steps of melting, casting, crushing, molding, and sintering. As a melt casting process, there can be employed processes such as vacuum melting and casting, melting and casting under an inert gas atmosphere, quench rolling, atomization, etc. In order to obtain a sintered magnet having improved magnetic characteristics and heat resistance, it is preferred to incorporate a step of heat treatment between the steps of casting and crushing so as to subject the product before crushing to a heat treatment at a temperature of 600° C. or higher under an inert gas atmosphere. In this manner, the irreversible demagnetization can be further lowered. In the sintering step, it is preferred to sinter the molding in the temperature range of 1,000 to 1,200° C. under an inert gas atmosphere and gradually cooling from the sintering temperature to a temperature in a range of 600 to 900° C., followed by quenching therefrom. The irreversible demagnetization can be further lowered by the quenching performed after the sintering.

The sintered magnet alloy according to the present invention can be produced in accordance with the production method for a sintered magnet described in Japanese Patent Public Disclosure No. 4-116144, except for the heat treatment and the quench treatment after the sintering described above. The process of production is outlined below.

The raw materials weighed as such to yield the desired alloy composition are molten in a vacuum melting furnace at a temperature of 1,600° C. or higher, and are casted by quenching in a water-cooled casting mold. As described above, the cast ingot thus obtained is thermally treated under gaseous Ar at a temperature of 600° C. or higher, and subjected to coarse crushing by using a jaw crusher. The coarse-grained powder thus prepared was finely milled by using a vibration ball mill to obtain a powder consisting of particles having an average diameter in a range of 2 to 10 $\mu$m. Those steps for such size reduction are carried out under gaseous Ar atmosphere. A part of the raw material for C can be added in the latter step of milling. That is, a part of the raw material for C is charged into the vacuum melting furnace, and the rest is added in this step of fine milling. Carbon black is suitable for use as the raw material of C, but also usable are organic materials containing C, such as an aliphatic hydrocarbon, a higher fatty acid alcohol, a higher fatty acid, a higher fatty acid amide, a metal soap, a fatty acid ester, etc.

Then, the powder thus obtained is compaction molded while applying an external magnetic field. The preferred range for the molding pressure is 1 to 5 t/cm$^2$, and that for the external magnetic field is 15 KOe or higher. The molding step also is preferably carried out under a gaseous Ar atmosphere. The molded product thus obtained is then sintered under gaseous Ar in the temperature range of 1,000 to 1,200° C. for a duration of about 2 hours. Then, as stated above, the resulting product is gradually cooled to a temperature in the range of 600 to 900° C., and quenched from the temperature. To initiate the quenching from a temperature in the range of 600 to 900° C., there can be employed a method of spraying a low temperature inert gas or a method of immersing the sintered product into water, an oil, or a liquid similar thereto, and preferably, rapid cooling is performed from the quench initiation temperature in the range of 600 to 900° C. to a temperature of 400° C. or lower at a cooling rate of –50° C./min or higher, preferably –100° C./min or higher.

Thus, in accordance with the present invention, there is provided a process for producing a permanent magnet alloy having an improved heat resistance comprising melting and casting each of the raw materials of the alloying elements, subjecting the resulting alloy to pulverizing, compaction molding the resulting powder, and sintering the molding under an inert gas atmosphere in a temperature range of 1,000 to 1,200° C. to obtain a sintered magnet alloy, characterized in that the alloy before pulverizing is thermally treated under an inert gas atmosphere at a temperature of 600° C. or higher, and/or that the process further comprises, after sintering the molding under an inert gas atmosphere in a temperature range of 1,000 to 1,200° C., gradually cooling the sinter from the sintered temperature to a temperature range of 600 to 900° C., followed by quenching. In the process, a part of the raw material of C may be added during melting, and the rest may be added during the pulverizing of the alloy.

The magnet according to the present invention is described in further detail below by making reference to representative examples.

EXAMPLE 1

An alloy having the composition below was produced by a process described hereinafter.

[Chemical composition of the alloy ( at. %)]

C: 5.0 at. %
B: 1.8 at. %
Co: 12.0 at. %
Nd: 13.0 at. %
Dy: 2.5 at. %
Tb: 0.5 at. %
Fe: 65.2 at. %

Where, C and B in total account for 6.8 at. %, Dy and Tb in total account for 3.0 at. %, and the ratio of Tb/Dy is 0.2.

[Production Process]

Each of the raw materials weighed as such to yield the desired alloy composition above were molten in a vacuum melting furnace. A part of the raw material for C was not fed into the melting furnace but was reserved. The melt thus obtained was quench cast in a water-cooled copper casting mold from 1,600° C. to obtain a cast alloy ingot. After heat treating under gaseous Ar at a temperature shown in Table 1, or without applying the heat treatment, the cast alloy ingot was coarsely crushed by using a jaw crusher, and the coarsely crushed product was fed into a vibration ball mill together with the reserved rest of the raw material for C to perform milling. Thus was obtained a powder having an average particle diameter of 5 $\mu$m.

The powder product thus obtained was molded under a magnetic field by applying a pressure of 2 t/cm$^2$ and an external magnetic field of 15 KOe. The resulting molding was sintered under gaseous Ar at 1,100° C. for a duration of 2 hours, and was gradually cooled from the sintering temperature to the temperature of initiating quenching shown in Table 1, at which temperature rapid cooling was started at a cooling rate also given in Table 1 by blowing gaseous Ar to the molding. The magnetic properties, heat resistance, and oxidation resistance of the resulting sinter were evaluated to obtain the results given in Table 1. The heat resistance and the oxidation resistance of the sinter were evaluated as follows.

[Evaluation of heat resistance]

(1) Measurement of irreversible demagnetization at 200° C.

The specimen was shaped in such a manner that the permeance coefficient (Pc) thereof be 1. More specifically, the specimen was cut out to a size of 2.5 mm×2.5 mm×1.05 mm.

The specimen thus obtained was magnetized by applying an external magnetic field of 50 KOe to measure the flux value at room temperature (25° C.). A flux meter manufactured by Toyo Jiki Kogyo Co. Ltd. equipped with an iron core coil was used to obtain the flux value. The flux value thus obtained was designated $A_{25}$.

The magnetized specimen thus obtained was maintained at 200° C. for a duration of 120 minutes. The heating held for a duration of 120 minutes was carried out in an oil bath filled with silicone oil. The temperature of the oil bath was precisely controlled so that the fluctuation in temperature may fall within a range of ±0.1° C. The specimen taken out from the oil bath was cooled sufficiently at room temperature to measure the flux value again by using the flux meter above. The flux value thus obtained was designated $A_{200}$. The irreversible demagnetization was calculated by using the observed $A_{25}$ and $A_{200}$ in accordance with the following equation:

$$\text{Irreversible demagnetization (200° C.) [\%]} = 100\times(A_{200}-A_{25})/A_{25}$$

(2) Measurement of Irreversible Demagnetization at 160° C.

The same procedure as that described in the measurement of irreversible demagnetization at 200° C. above was followed to obtain observed values $A_{25}$ and $A_{160}$, except for shaping the specimen in such a manner that the permeance coefficient (Pc) be 3 similar to the specimen described in the example of Japanese Patent Public Disclosure No.4-116144, and for heating the specimen in the oil bath at 160° C. for a duration of 120 minutes. Thus, irreversible demagnetization was calculated according to the equation above.

(3) Magnetization Measurements and the Temperature coefficient of coercive force After magnetizing the specimen by applying an external magnetic field of 50 KOe, the magnetization measurements at room temperature (RT; 25° C.) were conducted by using a vibrating-sample magnetometer. The temperature coefficient of coercive force was calculated in accordance with the following equation:

$$\text{Temperature coefficient of coercive force (\%/° C.)} = 100\times(B_1-B_0)/B_0/(160-25)$$

where, $B_0$ is the coercive force at room temperature, and $B_1$ is the coercive force obtained at 160° C. by using the same vibrating-sample magnetometer.

(4) Measurement of Oxidation Resistance

The progressive formation of rust was measured by performingpressure cooker test (PCT). More specifically, the specimen was held in a testing chamber manufactured by Tabai Espec Corp. at 120° C., 2 atm, and 100% RH (saturated condition) for a duration of 100 hours, and the generation of rust was visually observed.

TABLE 1

| Example 1 | Conditions of Production: Heat treatment temperature of cast alloy [° C.] | Temperature of starting quenching [° C.] | Cooling rate from starting quenching to 400° C. | Br (KG) | iHc (KOe) | BH max (MGOe) | Irreversible demagnetization [%] 200° C. Pc = 1 | 160° C. Pc = 3 | Coefficient of coercive force [%/° C.] | Generation of rust by PCT |
|---|---|---|---|---|---|---|---|---|---|---|
| a | 800 | 900 | −100° C./min | 12 | 17 | 34 | −3 | −0.7 | −0.32 | None |
| b | No treatment | 900 | −100° C./min | 12 | 17 | 32 | −10 | −1.2 | — | None |
| c | 800 | 1100 | −100° C./min | 12 | 17 | 33 | −9 | −1.0 | — | None |
| d | 800 | cooled to room temp. | 5° C./min to room temp. | 12 | 10 | 25 | −20 | −1.5 | — | None |

As shown in the results of Table 1 above, permanent magnet alloys having an irreversible demagnetization (200° C.) of −3% were obtained (see,forexample,Table 1a). Referring to Table 1, the irreversible demagnetization (160° C.) for alloy a is −0.7%, a value very close to 0%. Thus, it can be understood that a high magnetic force is achieved for the alloy even when used at high temperatures.

With respect to the conditions of production, it can be clearly seen by comparing the alloy a with the alloy b that the irreversible demagnetization can be lowered by performing heat treatment on the cast ingot. Furthermore, by comparing the results for alloys a, c and d, the coercive force can be improved and the irreversible demagnetization can be lowered by quenching the sintered alloy from a temperature of at least 700° C. or higher.

EXAMPLES 2 TO 16 AND COMPARATIVE EXAMPLES 1 TO 6

Sinters were prepared under the same production conditions as those employed for alloy a in example 1, except for changing the composition of the alloys as shown in Table 2. The characteristics of the thus obtained sintered magnets were obtained in the same manner as described in example 1, and the results were given in Table 2.

TABLE 2

| No. of Example | Composition of Alloy [% by atomic] C | B | Dy | Tb | Nd | Co | Fe | Dy + Tb | Tb/Dy | Br (KG) | iHc (kOe) | BH max (MGOe) | Irreversible demagnetization [%] 200° C. Pc = 1 | 160° C. Pc = 3 | Coefficient of coercive force [%/° C.] | Generation of rust by PCT |
|---|---|---|---|---|---|---|---|---|---|---|---|---|---|---|---|---|
| Example 2 | 5.0 | 1.8 | 2.5 | 1.0 | 13.0 | 12.0 | 64.7 | 3.5 | 0.4 | 11.0 | 17 | 31 | −4 | −0.7 | −0.26 | None |
| Example 3 | 4.0 | 3.0 | 2.5 | 0.5 | 13.0 | 12.0 | 65.0 | 3.0 | 0.2 | 12.0 | 17 | 32 | −5 | −0.8 | −0.27 | None |
| Example 4 | 5.0 | 1.8 | 3.5 | 0.4 | 13.0 | 12.0 | 64.3 | 3.9 | 0.1 | 11.5 | 17 | 30 | −7 | −0.9 | −0.28 | None |
| Example 5 | 5.0 | 1.8 | 0.4 | 0.3 | 13.0 | 12.0 | 67.0 | 0.7 | 0.8 | 13.5 | 13 | 38 | −20 | −1.5 | −0.42 | None |
| Example 6 | 5.0 | 1.8 | 3.8 | 0.7 | 15.0 | 12.0 | 61.7 | 4.5 | 0.2 | 11.5 | 17 | 28 | −7 | −0.9 | −0.29 | None |
| Example 7 | 3.5 | 1.0 | 2.5 | 0.5 | 13.0 | 12.0 | 67.5 | 3.0 | 0.2 | 12.0 | 17 | 33 | −10 | −1.2 | −0.31 | None |
| Example 8 | 5.0 | 1.8 | 2.5 | 0.5 | 10.0 Pr = 3.0 | 6.0 | 71.2 | 3.0 | 0.2 | 11.5 | 16 | 33 | −8 | −1.0 | −0.32 | None |
| Example 9 | 4.0 | 2.5 | 2.5 | 0.5 | 12.0 | 12.0 | 66.5 | 3.0 | 0.2 | 12.7 | 17 | 38 | −8 | −1.0 | | None |
| Example 10 | 4.0 | 2.5 | 3.0 | 0.5 | 12.0 | 12.0 | 66.0 | 3.5 | 0.2 | 12.5 | 17 | 34 | −11 | −1.0 | | None |
| Example 11 | 4.0 | 3.0 | 2.5 | 0.5 | 12.5 | 12.0 | 65.5 | 3.0 | 0.2 | 12.6 | 17 | 36 | −8 | −0.9 | | None |
| Example 12 | 5.0 | 1.8 | 1.0 | 0.5 | 13.0 | 12.0 | 66.7 | 1.5 | 0.5 | 13.0 | 14 | 35 | −15 | −1.1 | | None |
| Example 13 | 5.0 | 1.8 | 2.0 | 1.0 | 13.0 | 12.0 | 65.2 | 3.0 | 0.5 | 11.9 | 17 | 31 | −12 | −1.0 | | None |
| Example 14 | 5.0 | 1.8 | 1.5 | 2.0 | 13.0 | 12.0 | 64.7 | 3.5 | 1.3 | 11.8 | 17 | 29 | −18 | −1.4 | | None |
| Example 15 | 5.0 | 1.8 | 1.0 | 3.0 | 13.0 | 12.0 | 64.2 | 4.0 | 3.0 | 11.4 | 17 | 28 | −20 | −1.7 | | None |
| Example 16 | 5.0 | 3.5 | 0.5 | 2.0 | 13.0 | 12.0 | 64.0 | 2.5 | 4.0 | 12.3 | 17 | 34 | −19 | −1.4 | | None |
| Comparative Example 1 | 5.0 | 1.8 | 0 | 0 | 15.0 | 10.0 | 68.2 | 0 | — | 14.2 | 7 | 41 | −95 | −20.0 | * | None |
| Comparative Example 2 | 5.0 | 1.8 | 0.5 | 0 | 14.0 | 12.0 | 66.7 | 0.5 | 0 | 14.0 | 10 | 42 | −95 | −3.0 | * | None |
| Comparative Example 3 | 5.0 | 1.8 | 3.0 | 0 | 13.0 | 12.0 | 65.2 | 3.0 | 0 | 12.0 | 15 | 33 | −32 | −1.5 | −0.59 | None |
| Comparative Example 4 | 5.0 | 1.8 | 0 | 0.5 | 13.6 | 11.5 | 67.6 | 0.5 | — | 13.7 | 7 | 40 | −91 | −21.0 | * | None |
| Comparative Example 5 | 0.1 | 3.5 | 2.5 | 0.5 | 13.0 | 10.0 | 70.4 | 3.0 | 0.2 | 12.0 | 17 | 32 | −12 | −1.0 | −0.39 | Spotty rust |
| Comparative Example 6 | 4.0 | 1.8 | 0 | 3.0 | 13.0 | 12.0 | 66.2 | 3.0 | — | 12.7 | 16 | 33 | −30 | −1.5 | | None |

*) Unable to obtain accurate values due to large fluctuation in coercive force

As shown in Table 3, the permanent magnet alloys of Examples 2 to 16 in which both Dy and Tb are added all yield a low irreversible demagnetization at 200° C., and the irreversible demagnetization at 160° C. also is very close to 0%. Furthermore, it can be seen that they not only have a low temperature coefficient of coercive force, but also exhibit excellent oxidation resistance.

In contrast to the permanent magnet alloys of the examples above, the irreversible demagnetization at 200° C. for Comparative Example 1, in which no Dy nor Tb is added, is as large as −95%, that for Comparative Example 2 containing no Tb and 0.5 at. % Dy is −95%, and that for Comparative Example 4 containing no Dy and 0.5% by atomic Tb is −91%. It can be understood therefrom that these permanent magnet alloys completely lose their magnetic force when heated to 200° C. That is, the addition of Dy alone or Tb alone has no effect on the irreversible demagnetization at 200° C. Although the addition of Dy alone in a large amount, as shown in Comparative Example 3, lowers the irreversible demagnetization to some extent, the effect is not sufficient. Referring to Comparative Example 5, the oxidation resistance is inferior because the content of C falls lower than the range specified in the present invention. The alloy of Comparative Example 6 contains 3.0 at. % of Tb but no Dy. It can be seen that, although a favorable heat resistance is obtained, the irreversible demagnetization at 200° C. is as low as −30%.

FIG. 1 is a diagram showing how the values of irreversible demagnetization at 200° C. are influenced by the contents of Dy and Tb; all of the magnets given in Table 2 are plotted in the diagram wherein the abscissa shows the content of Dy ( at. %) and the ordinate shows the content of Tb ( at. %). The numerals provided in FIG. 1 each show the irreversible demagnetization at 200° C. for the plotted values.

Referring to FIG. 1, it can be understood that a peak (a point closest to 0%) in irreversible demagnetization at 200° C. is present for the area defined by 2 to 3 at. % Dy and 0.3 to 1.5 at. % Tb. More specifically, the straight lines indicated by numerals (1), (2), (3), (4), (5) and (6) define the areas with particular content of Dy and Tb, and the area which yield an irreversible demagnetization at 200° C. in the range of 0 to −20% can be defined by the crossing points A, B, C and D. Similarly, the area which yield an irreversible demagnetization at 200° C. in a range of 0 to −15% can be defined by the crossing points B, C, H, E, F and G. The straight lines (1) to (6) can be expressed by the following equations:

Line (1): Dy=0.3
Line (2): Tb+Dy =0.5
Line (3): Tb=0.1
Line (4): Tb=0.1 Dy
Line (5): Tb=0.8 Dy
Line (6): Tb+Dy =5.0

The coordinates (Dy at. %, Tb at. %) of the points A to H are obtained as follows:

Point A (0.3, 4.7)
Point B (0.3, 0.2)
Point C (0.4, 0.1)
Point D (4.9, 0.1)
Point E (4.5, 0.5)
Point F (2.8, 2,2)
Point G (0.3, 0.24)
Point H (1.0, 0.1)

Figure 2:
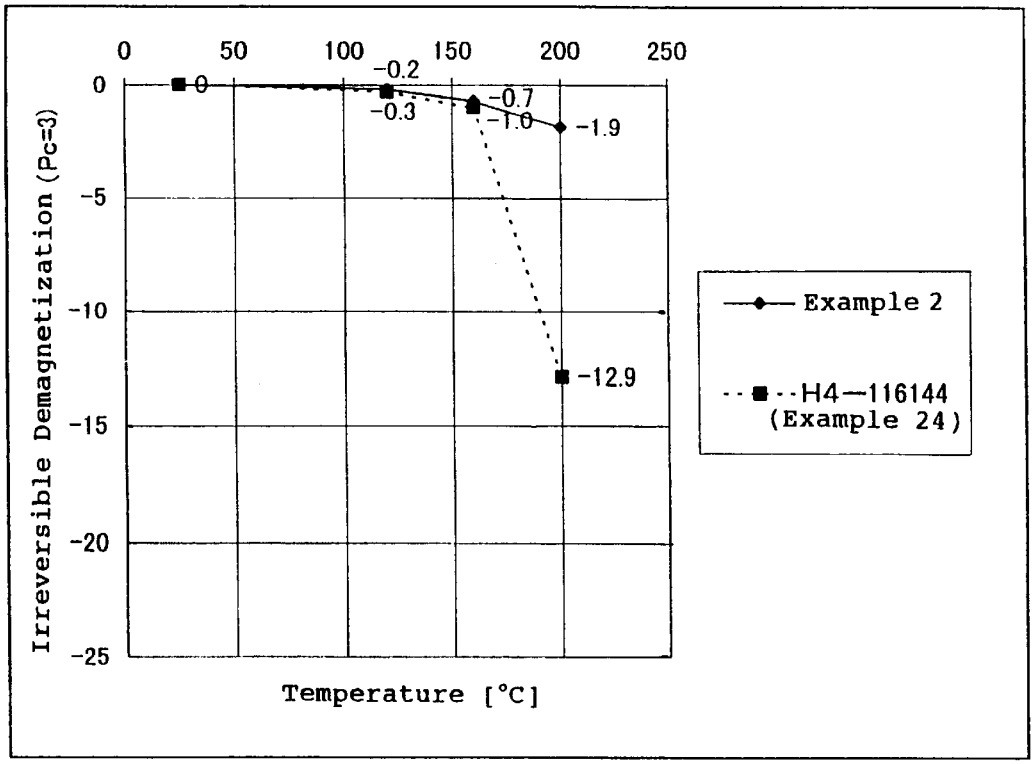
FIG. 2 is a diagram showing the observed irreversible demagnetization values at differing temperatures for the magnet described in Example 24 disclosed in Japanese Patent Public Disclosure No. 4-116144 and those of Example 2 according to the present invention, in which the specimens are each shaped as such that the permeance coefficient (Pc) be 3 and magnetized by applying 50 KOe.
Figure 3:
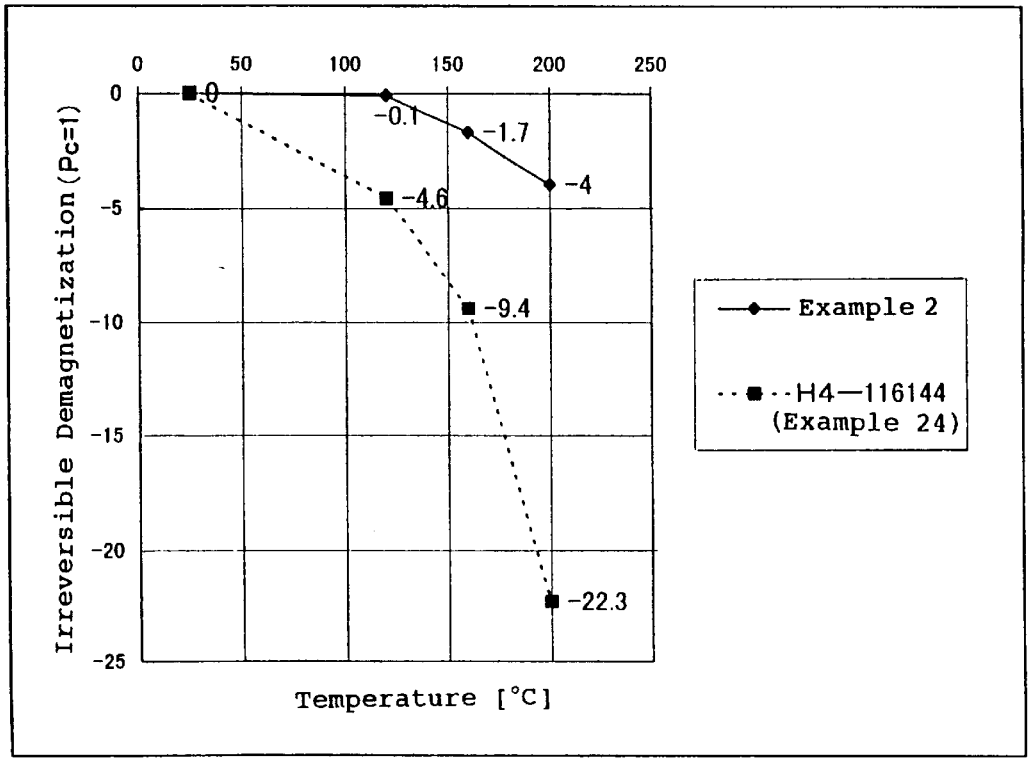
FIG. 3 is a diagram showing the observed irreversible demagnetization values similar to those shown in FIG. 2, except that the specimens are shaped as such that they may yield a permeance coefficient (Pc) of 1.

Referring to FIGS. 2 and 3, FIG. 2 shows the observed irreversible demagnetization values at different temperatures for the magnet having the highest heat resistance among the magnets disclosed in Japanese Patent Public Disclosure No. 4-116144 as described in Example 24 thereof and those of Example 2 according to the present invention, in which the specimens are each shaped as such that the permeance coefficient (Pc) be 3 and magnetized by applying an external magnetic field of 50 KOe. Similarly, FIG. 3 is a diagram showing the observed irreversible demagnetization values similar to those shown in FIG. 2, except that the specimens are shaped as such that they may yield a permeance coefficient (Pc) of 1. The magnet of Example 24 disclosed in Japanese Patent Public Disclosure No. 4-116144 (referred to hereinafter as "disclosed magnet") has a composition expressed by 9Nd—9Dy—59Fe—15Co—1B—7C and an irreversible demagnetization at 160° C. at Pc=3, according to the disclosure.

Referring to FIG. 2, the values of irreversible demagnetization at 160° C. for the specimens shaped as such to yield Pc=3 are −1.0% (disclosed magnet) and −0.7% (Example 2 of the present invention); i.e., the difference between them is not so large. Concerning the values of irreversible demagnetization at 200° C., however, the value of the magnet according to Example 2 of the present invention is improved to −1.9%, which can be contrasted to the value of −12.9% for the disclosed magnet. This tendency can be more clearly observed on the specimens shaped to yield Pc=1, as shown in FIG. 3. More specifically, at Pc=1, the values of irreversible demagnetization at 160° C. for the disclosed magnet is −9.4%, whereas that for the magnet according to Example 2 of the present invention is improved to −1.7%; moreover, the values of irreversible demagnetization at 200° C. for the disclosed magnet is −22.3%, whereas that for the magnet according to Example 2 of the present invention is far improved to −4%.

As described in detail above, the present invention provides a permanent magnet alloy having superior heat resistance and oxidation resistance never achieved in the field of R—Fe(Co)—B based magnets. Accordingly, the present invention provides materials having excellent magnetic properties at low cost, which can be advantageously assembled in appliances usable at elevated temperatures.

While the invention has been described in detail by making reference to specific embodiments, it should be understood that various changes and modifications can be made without departing from the scope and the spirit of the present invention.

What is claimed is:

1. A permanent magnet alloy having an improved heat resistance comprising, in terms of percent by atom ( at. %), a composition of:

0.1 to 15 at. % C, 0.5 to 15 at. % B, provided that C and B in total account for 2 to 30 at. %;

40 at. % or less Co, exclusive of zero percent, 0.5 to 5 at. % in total of Dy and Tb, 8 to 20 at. % R, where R represents at least one element selected from the group consisting of Nd, Pr, Ce, La, Y, Gd, Ho, Er, and Tm;

with the balance being Fe and unavoidable incidental impurities.

2. A permanent magnet alloy having an improved heat resistance according to claim 1, wherein a ratio of Tb( at. %)/Dy( at. %) is in a range of from 0.1 to 0.8.

3. A permanent magnet alloy having an improved heat resistance according to claim 1, wherein the content of C is in the range of 1 to 10 at. %.

4. A permanent magnet alloy having an improved heat resistance according to claim 1, wherein R is Nd alone or a combination of Nd and Pr.

5. A permanent magnet alloy having an improved heat resistance according to claim 1, wherein the alloy has an iHc of 13 KOe or higher.

6. A sintered magnet alloy based on R—B—C—Co—Fe having an improved heat resistance and comprising a composition according to claim 7, wherein the irreversible demagnetization at 200° C. according to the following equation (1) is 0% to −20%, where iHc is 13 KOe or higher:

$$\text{Irreversible Demagnetization at } 200^\circ \text{ C.} = 100\times(A_{200}-A_{25})/A_{25} \quad (1)$$

where $A_{25}$ represents a flux value of a magnet measured at room temperature, on a specimen prepared into a shape such that its permeance coefficient Pc is 1 and magnetized at 50 KOe; and $A_{200}$ represents a flux value of a magnet measured on the same specimen subjected to the measurement of $A_{25}$, which was maintained at 200° C. for 120 minutes and then cooled to room temperature, for the measurement.

7. A sintered magnet alloy based on R—B—C—Co—Fe having an improved heat resistance according to claim 6, wherein the alloy contains 0.3 to 4.9 at. % Dy and 0.1 to 4.7 at. % Tb, and the irreversible demagnetization at 200° C. is in the range of 0% to −20%.

8. A sintered magnet alloy based on R—B—C—Co—Fe having an improved heat resistance according to claim 6, wherein the content in at. % of Dy and Tb in total fall in the range defined by the points B, C, H, E, F, and G plotted in FIG. 1, and the irreversible demagnetization at 200° C. is in the range of 0% to −15%.

9. A sintered magnet alloy based on R—B—C—Co—Fe having an improved heat resistance according to claim 6, wherein the irreversible demagnetization at 200° C. is in the range of 0% to −5%.

10. A process for producing a permanent magnet alloy having an improved heat resistance according to claim 1 which comprises (a) melting and casting raw materials of alloying elements to produce an alloy, (b) thermally treating the alloy under an inert gas atmosphere at a temperature of 600° C. or higher, (c) subjecting the resulting alloy to pulverizing to produce a powder, (d) compression molding the resulting powder, and (e) sintering the resultant molding under an inert gas atmosphere in a temperature range of 1,000 to 1,200° C. to obtain a sintered magnet alloy containing, in terms of % by atom, 0.1 to 15 at. % C, 0.5 to 15 at. % B, provided that C and B in total account for 2 to 30 at. %, 40 at. % or less Co exclusive, 0.5 to 5 at. % in total of Dy and Tb, 8 to 20 at. % R, where R represents at least one element selected from the group consisting of Nd, Pr, Ce , La, Y, Gd, Ho, Er and Tm; with the balance being Fe and unavoidable impurities.

11. A process for producing a permanent magnet alloy according to claim 10, wherein the process further comprises, after sintering the molding under an inert gas atmosphere in a temperature range of 1,000 to 1,200° C., gradually cooling the sinter from the sintered temperature to a temperature range of 600 to 900° C. followed by quenching.

12. A process for producing a permanent magnet alloy according to claim 10, wherein a part of the raw material oc C is added during melting, and the rest is added during the pilverizing of the alloy.

13. A permanent magnet alloy having an improved heat resistance according to claim 2, wherein the content of C is in the range of 1 to 10 at. %.

14. A permanent magnet alloy having an improved heat resistance according to claim 2, wherein R is Nd alone or a combination of Nd and Pr.

15. A permanent magnet alloy having an improved heat resistance according to claim 3, wherein R is Nd alone or a combination of Nd and Pr.

16. A permanent magnet alloy having an improved heat resistance according to claim 2, wherein the alloy has an iHc of 13 KOe or higher.

17. A permanent magnet alloy having an improved heat resistance according to claim 3, wherein the alloy has an iHc of 13 KOe or higher.

18. A permanent magnet alloy having an improved heat resistance according to claim 4, wherein the alloy has an iHc of 13 KOe or higher.

19. A sintered magnet alloy based on R—B—C—Co—Fe having improved heat resistance according to claim 6, wherein the room temperature is 25° C.

20. A sintered magnet alloy based on R—B—C—Co—Fe having improved heat resistance according to claim 6, wherein the ratio of Tb in at. %/Dy in at. % is 0.1 to 0.8.

21. A process for producing a permanent magnet alloy according to claim 11, wherein a part of the raw material for C is added during melting, and the rest of the raw material for C is added during the pulverizing of the alloy.

* * * * *

UNITED STATES PATENT AND TRADEMARK OFFICE

CERTIFICATE OF CORRECTION

PATENT NO. : 6,319,336 B1
DATED : November 20, 2001
INVENTOR(S) : Masami Kamada et al.

It is certified that error appears in the above-identified patent and that said Letters Patent is hereby corrected as shown below:

Title page,
Item [56], References Cited, U.S. PATENT DOCUMENTS, replace "5,147,919" with -- 5,147,473 --.

Column 12,
Line 3, replace "7" with -- 1 --.

Signed and Sealed this

First Day of June, 2004

JON W. DUDAS
*Acting Director of the United States Patent and Trademark Office*